United States Patent [19]

Kröcher

[11] Patent Number: 4,544,009

[45] Date of Patent: Oct. 1, 1985

[54] SCRATCHER ELEMENT FOR A WOOD-CUTTING TOOL

[75] Inventor: Harro Kröcher, Bad Kreuznach, Fed. Rep. of Germany

[73] Assignee: Hombak Maschinenfabrik GmbH & Co. KG, Bad Kreuznach, Fed. Rep. of Germany

[21] Appl. No.: 573,033

[22] Filed: Jan. 23, 1984

[30] Foreign Application Priority Data

Jan. 21, 1983 [DE] Fed. Rep. of Germany ... 8301544[U]

[51] Int. Cl.[4] ..... B27G 13/04

[52] U.S. Cl. ..... 144/230; 144/42; 144/172; 241/294; 407/45; 407/50

[58] Field of Search ..... 144/42, 39, 162 R, 230, 144/218, 172, 174; 241/294; 407/37–39, 45, 49, 94–96, 50, 100

[56] References Cited

U.S. PATENT DOCUMENTS 4,068,694 1/1978 Schmidt et al. ..... 144/230
4,470,442 9/1984 Krautzberger ..... 144/42

FOREIGN PATENT DOCUMENTS 7616598 2/1978 Fed. Rep. of Germany .
3120249 12/1982 Fed. Rep. of Germany .

*Primary Examiner*—W. D. Bray
*Attorney, Agent, or Firm*—Michael J. Striker

[57] ABSTRACT

A scratcher element in a cutter arrangement of a wood-cutting tool is formed of a rectangular plate and two projections outwardly extended from the side faces of the plate. The scratcher element is inserted in a special slot formed in a supporting strip of the cutter arrangement. These two projections each have a cross-section of the shape of a segment of the circular disc.

6 Claims, 3 Drawing Figures

A
1
2
3
4
4
8
9
15

I
I
4
5
6
7
8
9

5
8
9
9
10
10
11
12
13
D
D

SCRATCHER ELEMENT FOR A WOOD-CUTTING TOOL

BACKGROUND OF THE INVENTION

The present invention relates to a scratcher element which is received in a supporting strip of a wood-cutting tool, preferably secured to a cutter spindle.

The scratcher element includes a plate which is of a substantially rectangular shape and has two opposite scratching edges.

One of such scratcher elements is disclosed in German patent application DE-OS No. 3,120,249. A cutter spindle is described in this application, to the body of which a hook-shaped locking member is screwed, in which a wearing strip is inserted. A cutter with a projecting cutting edge is supported on that wearing strip. This wearing strip forms the aforementioned supporting strip in which slots for receiving the rectangular scratcher plates are formed. Each of these scratcher plates has at each side thereof an outwardly projecting pin which is engaged in an insertion groove open towards the cutter. This pin forms a projecting attachment which makes it possible a turning of scratcher plates at 180° about the axis of the pin as well as perpendicularly thereto so that each scratcher plate can be used many times.

The same holding device for a rotary cutter of a wood cutting tool normally holds a resharpenable cutter and scratcher elements. The scratcher elements are held in the supporting strip in the form-locking fashion.

The term "form-locking" is used in this disclosure to identify an inter-engaging connection in which the shapes of respective elements complement each other.

Another construction of multiple-utilized scratcher elements is disclosed in German publication DE-GM No. 76 16 598. The scratcher elements, during the wood-cutting process, are subjected to frequently occurring impacts and high loads, which in the region of the aforementioned attachments, serving to provide form-locking connections between the scratcher elements and the wearing plate, cause high compressing forces acting on the surfaces of the attachments. These compressing forces cause eventually high surface deformations in the seat regions of the scratcher elements. This causes arresting of the scratching elements which, during the cutting process, could cause braking the scratcher elements.

SUMMARY OF THE INVENTION

It is an object of the present invention to provide an improved holding means for supporting scratcher plates in the woodcutting tool.

This and other objects of the invention are attained by a scratcher element for a wood-cutting tool having a cutter spindle and a cutter support carrying cutters and including a supporting strip which receives the scratching element in the form-locking fashion, the scratcher element comprising a substantially rectangular scratcher plate having two opposite scratcher edges extending parallel to each other and two attachments, said plate having one central plane through which said edges extend and another central plane normal to said one central plane, said attachments being disposed centrally between said opposite edges, said plate having two opposite side faces, each of said attachments being formed at a respective one of said opposite side faces so that said attachments are mirror-inverted in respect to said one central plane and in respect to said another central plane, said supporting strip being formed with at least one recess receiving said attachments in a form-locking fashion, each of said attachments as viewed in a plan view of a scratcher edge-free side of the scratcher element having the form of a segment of a circular disc.

The structure of the scratcher element provides for optional supporting of the element in the supporting strip in which a slot as well as a recess or opening must be provided for receiving the scratcher elements. The manufacturing of such slots and recesses is particularly simple. High loads acting on the scratcher elements can be taken up by cylindrical, practically play-free seats, whereas the seats comprised of through bores and pins result in substantial plays.

The scratcher plate and said attachments may be formed as one-piece so that the plate would be formed with two opposite outwardly extending projections.

Each attachment may be flattened by a secant extended parallel to said one central plane. Thereby one can save costly sinter material without, however, affecting precision of the scratcher elements.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
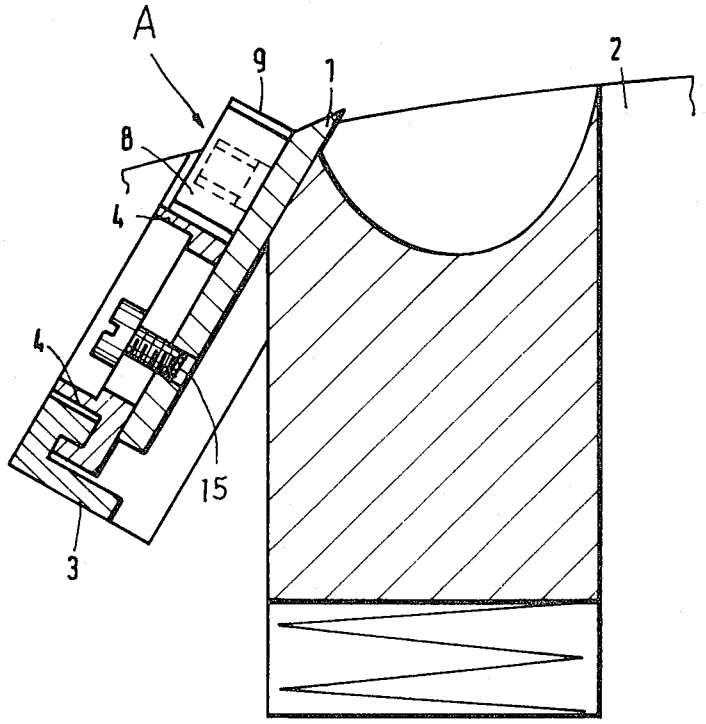
FIG. 1 is a sectional view along line 1—1 of FIG. 2, illustrating a cutter support with a scratcher according to the invention.
Figure 2:
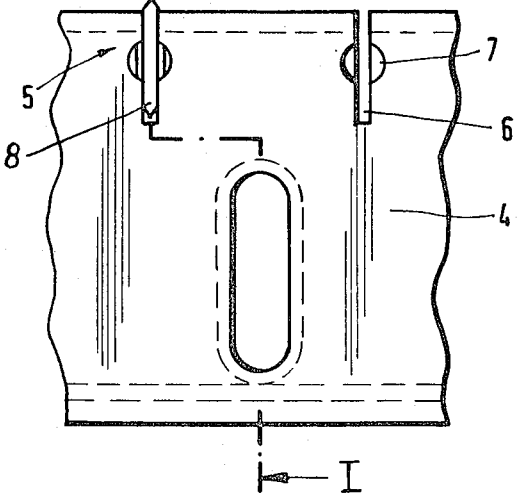
FIG. 2 is a top plan view of a supporting strip, in portion, for supporting the scratcher elements as seen in the direction of arrow A of FIG. 1.

A cutter support illustrated in FIG. 1 serves for securing a cutter 1 having a projecting cutting edge to a rotary cutter spindle 2. A hook-like locking element 3 is mounted on the body of the cutter spindle 2 by means of screws. A supporting strip 4 supporting a plurality of scracther elements 5, as shown in FIG. 2, is engaged with and supported by the locking element 3. The back side of the cutter 1 is supported against the rear face of supporting strip 4. Cutter 1, in the exemplified embodiment, is secured to supporting strip 4 by screws 15.

Supporting strip 4 serves for receiving and supporting scratcher elements 5, which are mounted in supporting strip 4 at predetermined intervals from each other, as shown in FIG. 2. A slot 6 and a bore or recess 7 are formed in supporting strip 4 for each scratcher element.

Figure 3:
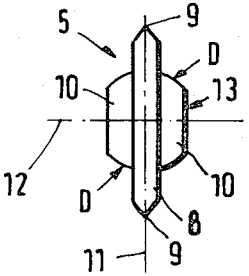
FIG. 3 is a view of the scratcher element of FIG. 2 on enlarged scale.

The scratcher element generally designated as 5, is shown in FIG. 3. This element is comprised of a scratcher plate 8 of rectangular or square cross-section, which has at two opposing ends thereof scratcher edges 9 extending paralelly to each other, and two attachments or projections 10. Each attachment 10 extends outwardly from the respective side surface of scratcher plate 8 and is formed midway between two opposing scratcher edges 9. These two attachments are locked in the respective bore 7, formed as a recess, in the form-locking manner, whereas slot 6 receives plate 8.

As shown in FIG. 3, both attachments 10 are in alignment to each other and are mirror-inverted in respect to plane 11 extending through the opposite scratcher edges 9 as well as in respect to a middle plane 12 extending normally to plane 11. FIG. 2 illustrates the top plan view of the scratcher edge-free front side of the scratcher 5. In this view, each attachment 10 has the form of the segment of the circular disc with the diameter D so that each attachment 10 is flattened by a secant 13 extended parallel to the plane 11 projecting through the scratcher edges 9.

The plate 8 and attachments 10 are formed as a one-piece member.

The scratching or scoring element 5 may be formed of a sintered metal.

It will be understood that each of the elements described above, or two or more together, may also find a useful application in other types of scratcher elements differing from the types described above.

While the invention has been illustrated and described as embodied in a scratcher element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A scratcher element for a wood-cutting tool having a cutter spindle and a support holding a cutter and including a support strip which receives the scratcher element, the scratching element comprising a substantially rectangular scratcher plate having opposite end faces and two opposite scratcher edges, and two attachment projecting outwardly of said end faces, said plate having a central plane, said edges extending through said central plane, said attachments being disposed centrally between said opposite edges, said attachments being mirror-inverted in respect to said central plane, said supporting strip being formed with at least one recess receiving said attachments in a form-locking fashion, each of said attachments having a shape of a segment of a circular disc.

2. The element as defined in claim 1, wherein said plate and said attachments are formed as one-piece.

3. The element as defined in claim 2, wherein the element is formed of sintered metal.

4. The element as defined in claim 2, wherein each attachment is flattened by a secant extended parallel to said central plane.

5. The element as defined in claim 1, wherein said plate is square.

6. The element as defined in claim 1, wherein said recess is circular.

* * * * *